US008227779B2

(12) United States Patent
Neff

(10) Patent No.: US 8,227,779 B2
(45) Date of Patent: Jul. 24, 2012

(54) GAS DISCHARGE SOURCE FOR GENERATING EUV-RADIATION

(75) Inventor: Jakob Willi Neff, Kelmis (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 224 days.

(21) Appl. No.: 12/747,520

(22) PCT Filed: Dec. 16, 2008

(86) PCT No.: PCT/IB2008/055344
§ 371 (c)(1),
(2), (4) Date: Jun. 11, 2010

(87) PCT Pub. No.: WO2009/077980
PCT Pub. Date: Jun. 25, 2009

(65) Prior Publication Data

US 2010/0264336 A1 Oct. 21, 2010

(30) Foreign Application Priority Data

Dec. 18, 2007 (DE) ..... 10 2007 060 807

(51) Int. Cl.
*H05G 2/00* (2006.01)

(52) U.S. Cl. ..... 250/504 R; 378/119; 378/144

(58) Field of Classification Search ..... 250/504 R; 378/119, 144
See application file for complete search history.

(56) References Cited

U.S. PATENT DOCUMENTS

| | | | | |
|---|---|---|---|---|
| 7,626,188 | B2 * | 12/2009 | Shirai et al. | 250/504 R |
| 7,630,475 | B2 * | 12/2009 | Neff et al. | 378/119 |
| 2007/0090304 | A1 | 4/2007 | Jonkers et al. | |
| 2007/0158594 | A1 | 7/2007 | Shirai et al. | |

FOREIGN PATENT DOCUMENTS

| | | | |
|---|---|---|---|
| DE | 10342239 | A1 | 6/2005 |
| DE | 102005023060 | A1 | 11/2006 |
| JP | 2007200919 | A | 8/2007 |
| JP | 2007305908 | A | 11/2007 |

* cited by examiner

*Primary Examiner* — Kiet T Nguyen

(57) ABSTRACT

The present invention relates to a gas discharge source, for generating EUV radiation and/or soft X-radiation, comprising at least two electrode bodies (110,120), of which a first electrode body (110) comprises a rotatably mounted electrode disk (100). The source further comprises a rotary drive (130) for the electrode disk, a device for applying a liquid film of a target material (140) onto a radial outer surface of the electrode disk (100), and a laser that is focussed, within a discharge area (240), onto the radial outer surface of the electrode disk (100) to evaporate target material. The source is characterized by an intermediate space (160) is formed between the electrode bodies, which intermediate space has a reduced width of <5 mm outside the discharge area (240), which is smaller than the intermediate space in the discharge area. The source enables the generated radiation to be emitted in a simple manner through a larger solid angle, without being shadowed by the electrodes.

14 Claims, 5 Drawing Sheets

GAS DISCHARGE SOURCE FOR GENERATING EUV-RADIATION

TECHNICAL FIELD

The present invention relates to a gas discharge source, in particular for generating extreme ultraviolet (EUV) radiation and/or soft X-radiation, comprising at least two electrode bodies, of which a first electrode body includes a rotatably mounted electrode disk, and comprising a rotary drive for the electrode disk, a device for applying a liquid film of a target material onto a radial outer surface of the electrode disk, and a laser for emitting a laser beam that is focussed, within a discharge area, onto the radial outer surface of the electrode disk to evaporate target material from the liquid film.

PRIOR ART

In the case of gas discharge-based radiation sources, of which the gas discharge source in accordance with the present invention forms part, a plasma is generated in an electrode system by means of a pulsed current, which plasma, in the case of a suitable choice of a target material in the discharge area, can be a source of EUV radiation or of soft X-radiation.

Figure 1:
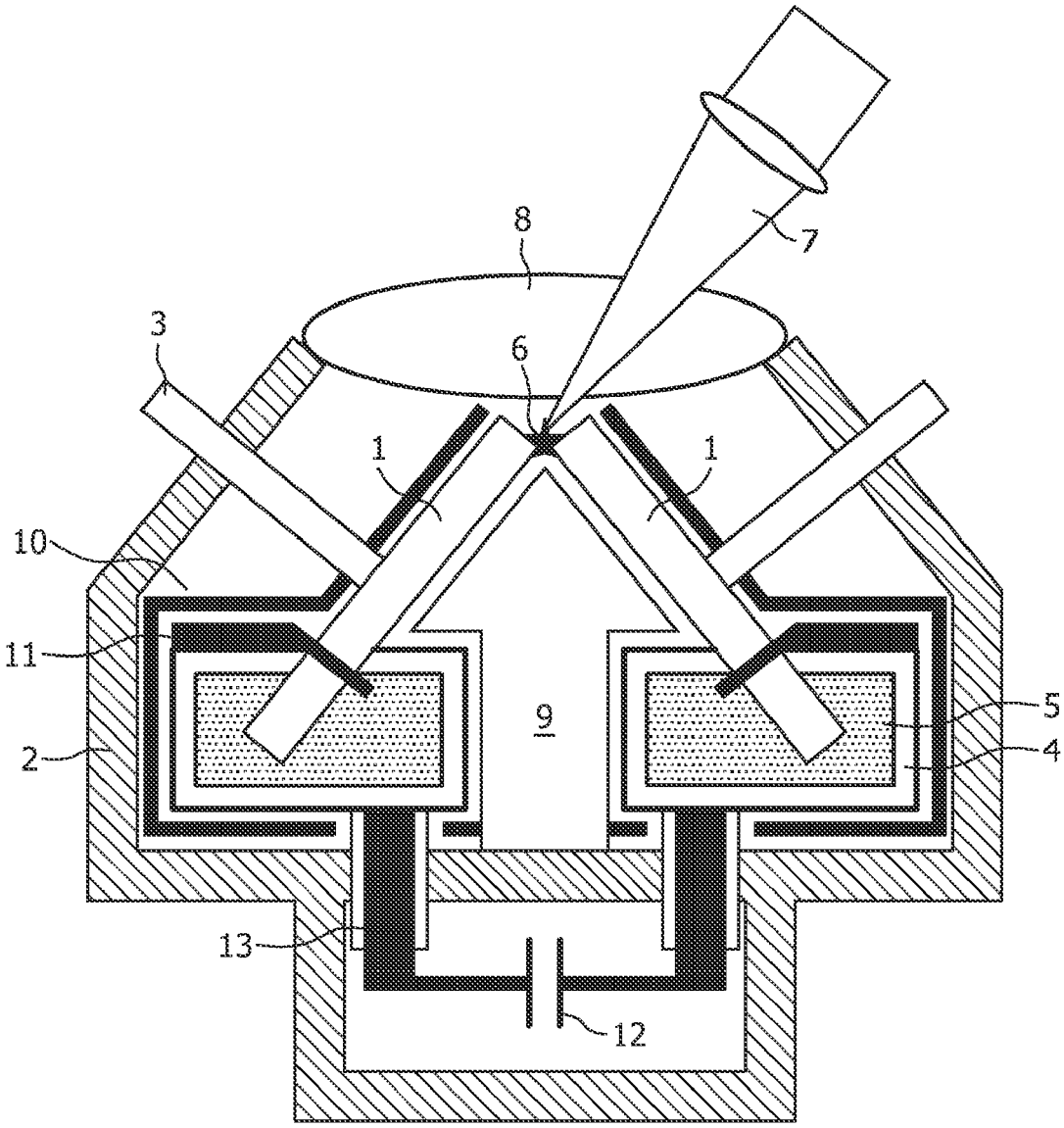

DE 103 42 239 A1 shows a gas discharge source having a special structure of the electrodes, the current supply and the cooling system, and employing a special technique for providing the target material. FIG. 1 shows a diagrammatic representation of this radiation source in a cross-sectional view showing two rotatably mounted, disk-shaped electrodes 1 in a vacuum chamber 2. The electrodes are arranged in such a manner that in the case of autorotation about their rotation axles, which are each connected to a drive for generating the rotation, the electrodes are immersed in two reservoirs 4 containing liquid metal 5, for example tin. This rotation causes the formation of a thin metal film on the circular circumference of the electrodes 1. In a spatial position, the two electrodes 1 form a very small interspace, in the area of which a gas discharge 6 is ignited. This ignition takes place using a coupled-in laser pulse 7 which is focussed on a surface of the circular circumference of the electrodes 1. The Figure further shows a device 8 for reducing debris, a metallic screen 9 between the electrodes 1 as well as an outer screen 10 at the wall of the vacuum chamber 2. In addition, scrapers are shown, by means of which the thickness of the liquid film on the electrodes can be adjusted. The current supply takes place via a capacitor bank 12 and suitably insulated electric leadthroughs 13 to the metal baths.

With this gas discharge source, the electrode surface subjected to the gas discharge is continually regenerated, so that advantageously the base material of the electrodes is not subject to wear. Furthermore, as a result of the rotation of the electrode disks through the metal melt, there is a close thermal contact, enabling the disks heated by the gas discharge to efficiently dissipate energy to the melt. As a result, the rotating electrode disks do not require separate cooling. As the electric resistance between the electrode disks and the metal melt is very low, very high currents can be transmitted via the melt to the electrode disks, which very high currents are necessary in the gas discharge for generating a very hot plasma suitable for generating radiation. In this manner, current can be fed from the outside to the electrodes in a stationary manner via one or more leadthroughs to the metal melt.

In this gas discharge source, the electrode disks are preferably arranged in a vacuum system, which attains at least a base vacuum of $10^{-2}$ Pa. As a result, a high voltage of, for example, 2-10 kV from the capacitor bank can be applied to the electrodes, without this leading to an uncontrolled electric breakdown. The electric breakdown is purposefully triggered by the laser pulse, which is focused, at the narrowest location between the electrode disks, onto the radial outer surface of one of the electrode disks. As a result, part of the metal film present on the electrodes evaporates and bridges the distance between the electrodes. Electric breakdown takes place at this location and a very high current flow from the capacitor bank occurs. This current heats the metal vapor to temperatures at which the vapor is ionized and emits the desired radiation in a pinch plasma.

Figure 2:
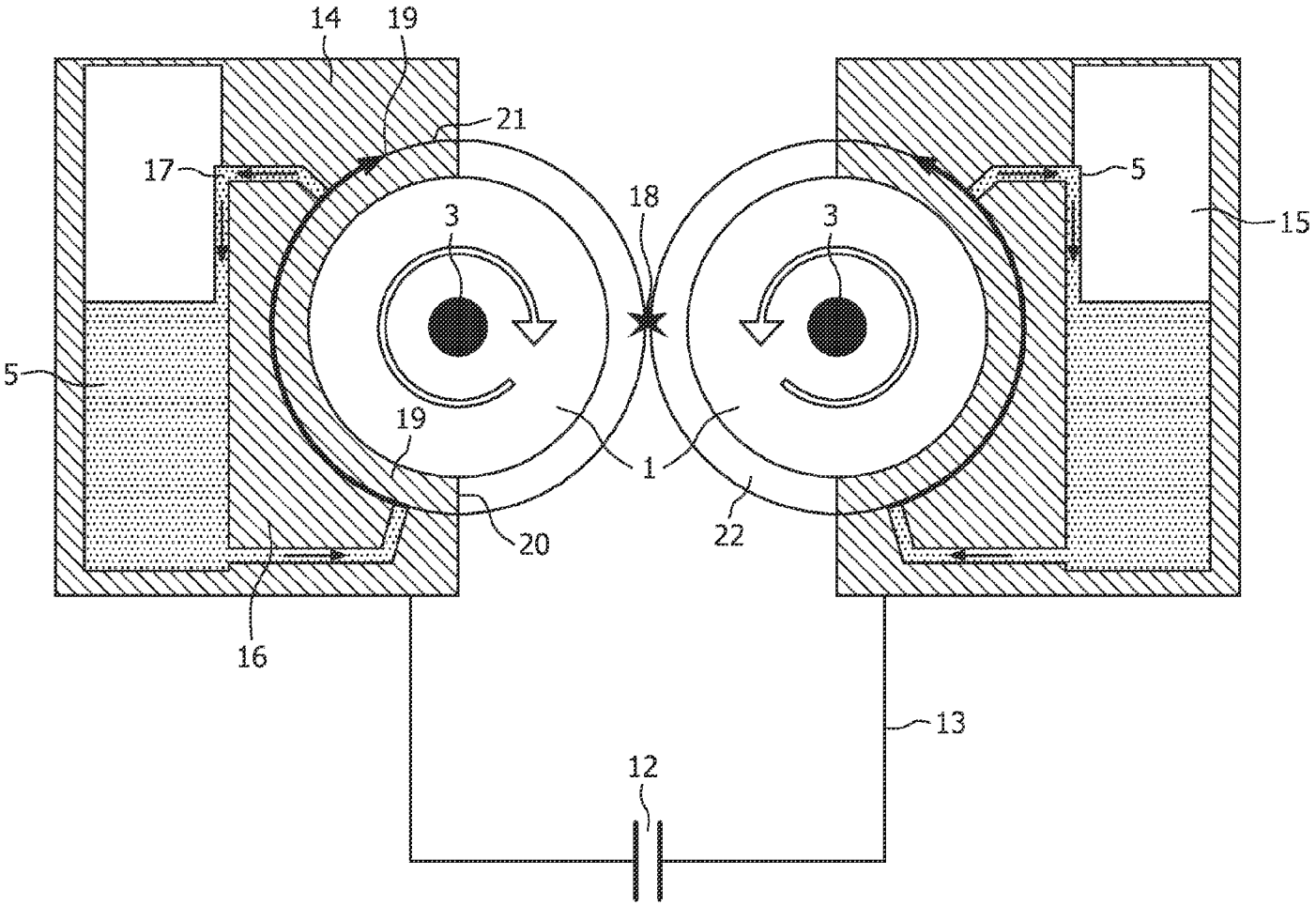

A further development of this gas discharge source is described in DE 10 2005 023 060 A1. In this publication, the two electrode disks no longer rotate freely in their respective, large baths comprising a metal melt. The contact with the metal melt is rather limited to a gap 19 between a part of the disk circumference and a metal block 14 as counterform. If this gap is sufficiently narrow, capillary forces will cause the liquid metal to be retained, and even when it is subjected to a certain pressure, for example caused by gravity, it will not flow out. FIG. 2 shows, by way of example, such an arrangement of the electrode system in a diagrammatic view. In this example, the metallic block comprises a reservoir 15 containing a supply of liquid metal 5. As a result of the rotation of the electrode disks 1 about their axles of rotation 3, the metal in the gap 19 is transported upwards in the direction of rotation, any excess metal at the upper end of the gap 19 flowing back into the reservoir 15 via a return channel 17. The rotation is indicated by means of arrows. In order to preclude the liquid metal 5 from flowing out of the gap 19, said gap is made particularly narrow, in this example, at the inlet 20 and outlet 21. Between the supply channel 16 and the return channel 17, the gap 19 may very well have an area having a thickness of 1 mm in order to minimize frictional forces between the electrode 1 and the block 14. In principle, in the case of the present gas discharge source, the circulation of the liquid, electrically conductive material may additionally be supported by a pump. The reservoir containing the liquid metal does not necessarily have to be situated in the metal block 14. It may alternatively be a separate vessel connected to the metal block 14 by means of suitable feeding pipes.

The storage capacitors are connected directly to the metal block 14, as shown in FIG. 2. In this manner an electric connection of low resistance is established to the electrodes via the liquid metal 5. The source point 18 for the gas discharge is determined, in the present example, by the focal point of a laser beam (not shown). This is in accordance with the mode of operation as explained hereinabove in connection with the gas discharge source described in the opening paragraph.

As a result of the structure of the electrode system of these gas discharge sources, in which the radiation-emitting plasma is generated in the area of the narrowest location between the rotating electrode disks, the spreading of the emitted radiation is at least partly impeded by the electrodes themselves. Due to the shadow effect, the radiation cannot simply spread in a solid angle of $2\pi$ sr, as would be desirable for a number of applications.

It is an object of the present invention to provide a gas discharge source having a less intricate construction and enabling, at a comparable low degree of wear, to emit radiation, generated by means of the gas discharge, also in a solid angle of $2\pi$ sr.

DISCLOSURE OF THE INVENTION

This object is achieved by means of the gas discharge source as claimed in Claim 1. Advantageous embodiments of the gas discharge source are disclosed in the sub-claims or can be inferred from the following description and the exemplary embodiments.

The proposed gas discharge source comprises at least two electrode bodies, of which a first electrode body comprises a rotatably mounted electrode disk. Furthermore, the gas discharge source comprises a rotary drive for the electrode disk, a device for applying a liquid film of a target material onto a radial outer surface of the electrode disk, and at least one laser for the emission of a laser beam, which laser is focused, in a discharge area, onto the radial outer surface of the electrode disk in order to evaporate target material from the liquid film. The gas discharge source is characterized in that between the electrode bodies (110, 120) an intermediate space (160) is formed, the width of which outside the discharge area (240) is reduced, as compared to a distance in the discharge area (240), to <5 mm. The intermediate space preferably takes the form of a free gap between the electrode bodies, however, it may also be partly or completely filled with an insulating material, for example a ceramic material.

By virtue of this embodiment and arrangement of the electrode bodies, an operation can take place on the left-hand branch of the Paschen curve in the gas-discharge process, in which operation, for example, a gas surrounding the electrode bodies may exhibit a pressure of at least 1 Pa. During the gas-discharge process, ionized gas in the narrow gap between the electrode bodies is rapidly neutralized, while, between two discharge pulses, ionized gas in the discharge area and above the discharge area, does not have sufficient possibility to neutralize and hence remains at least partly ionized. Consequently, in this discharge area, the pre-ionization guarantees a discharge, whereas flashover or gas discharges in the narrow gap are precluded. If the gap is filled with an insulation material, flashover in this area is absolutely impossible. Thus, unlike the prior art, the electrodes must no longer be arranged such that the discharge area is formed by an area of very small interspace between the electrode disks, while the electrodes must be spaced further apart at all other locations. The proposed gas discharge source thus enables a gas discharge process to be achieved in which shadow effects due to the electrode bodies are reduced as compared to the prior art.

In a preferred embodiment the two electrode bodies are designed and arranged such that the second electrode body does not project above the electrode disk in a direction perpendicular to the disk's radial outer surface in the discharge area. It is particularly preferred for the electrode disk to project above the second electrode body in a direction perpendicular to its radial outer surface in the discharge area. In this manner it is advantageously achieved that the radiation-generating plasma can emit radiation in a solid angle of $2\pi$ sr or larger.

It has been found that in such an embodiment of the electrode system, supplying the target material via one of the two electrode bodies for the operation of the gas discharge source is completely sufficient. In the case of the present gas discharge source, this supply takes place via the rotating electrode disk, which takes up the liquid target material. In this case, the second electrode body may be designed so as to be completely stationary.

In a preferred embodiment, the second electrode body laterally encloses the first electrode body. For example, the second electrode body may comprise a gap in a part facing the discharge area for allowing passage of the electrode disk, and otherwise be designed so as to be preferably rotationally symmetrical about the first electrode body. The second electrode body may be, for example, dome-shaped.

The above-mentioned embodiments enable the formation of an inner, first electrode body, in which a rotating electrode disk for taking up the target material is arranged at its radial outer surface, and which first electrode body is laterally surrounded by an outer, second electrode body, thereby forming said interspace, for example a gap with said small gap dimension. The inner, first electrode can for example be used as a cathode, and the outer, second electrode as an anode of the electrode system. The small dimension of the gap between the two electrode bodies may advantageously increase at the location of the discharge area.

In the proposed gas discharge source, the rotating electrode disk as well as the device for applying the liquid film of the target material onto the radial outer surface of the electrode disk can be designed as described in the two applications DE 103 42 239A1 and DE 10 2005 023 060 A1 mentioned in the opening paragraph. In one case mentioned therein, the electrode disk is partly immersed in a receptacle containing the liquid target material in order to be moistened by a thin film of this target material. In the other case, a part of the circumference of this electrode disk is surrounded by a metal block, via which part of the circumference liquid target material can be supplied into a gap between the metal block and the electrode disk in order to moisten the electrode disk with a liquid metal film in the same manner. The electrode disk is preferably rotatably mounted in the metal block as the first electrode body. In both embodiments, one or more scrapers may be provided in the same manner as in the above-mentioned printed publications, in order to limit the thickness of the thin film on the radial outer surface of the electrode disk. In addition, a supply of the liquid target material can be maintained at a desired temperature above the melting point of the target material by means of a cooling device. Also the electric contacting of the electrode disk can take place in the same manner via the metallic melt, so that no moving parts are necessary for the energy supply. Of course, also other embodiments for supplying the target material to the radial outer surface of the electrode material can be used, as described in the above-mentioned printed publications. Furthermore, preferably also the electrodes are maintained at temperatures that are, for example, just above the melting point of the target material by means of a cooling system.

The two electrode bodies are situated in a vacuum vessel in which a pressure of an inert or working gas is maintained which is suitable for the operation of the gas discharge source. The pressure is chosen to be such that operation of the gas discharge source takes place on the left-hand branch of the Paschen curve. In this manner, gas discharges in the narrow gap between the two electrode bodies are precluded. A motor for the rotary drive of the electrode disk is preferably arranged outside the vacuum vessel and drives the electrode disk preferably via a suitable lubrication-free belt. This belt should be designed for temperatures in excess of 250° C. and may be made, for example, of a metal.

As a result of the operation of the gas discharge source, metallic material is continually removed from the electrode disk and, for example, deposited also on the surface of the second electrode body. The removal of this material can take place, for example, by the sputter effect of the gas discharge itself, by draining it away as a liquid or by evaporation as a result of a sufficiently high surface temperature. In a further embodiment, the second electrode body comprises one or more rotatable components which extend as far as the discharge area. Any material that is deposited on these rotatable components is then removed from the discharge area by the rotation of these components and can be carried off at another location, for example by suitable scrapers.

SHORT DESCRIPTION OF THE DRAWINGS

The proposed gas discharge source will be described hereinbelow by means of exemplary embodiments and with reference to the accompanying drawings, without the scope of protection given by the patent claims being limited.

Figure 3:
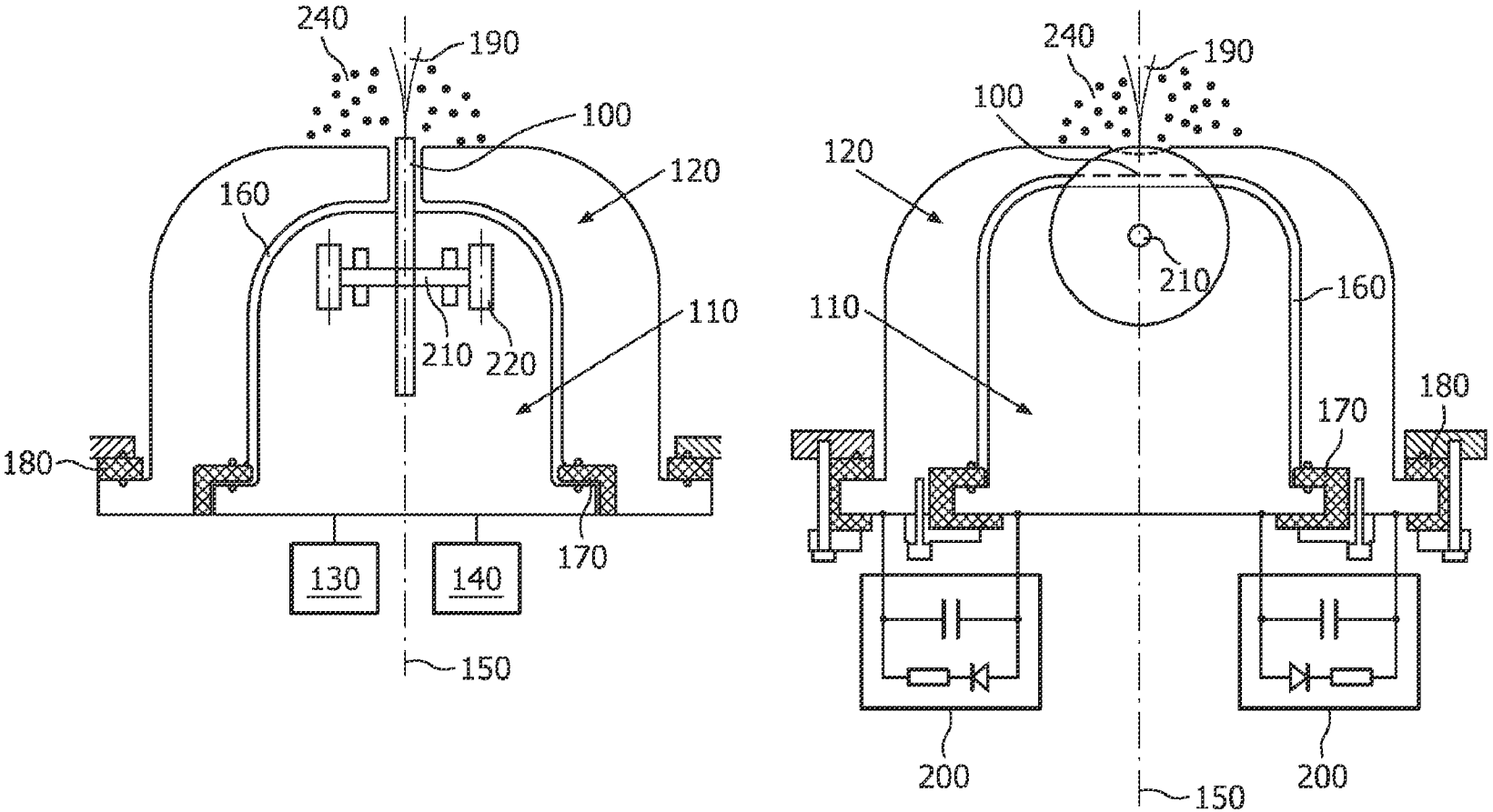
Figure 4:
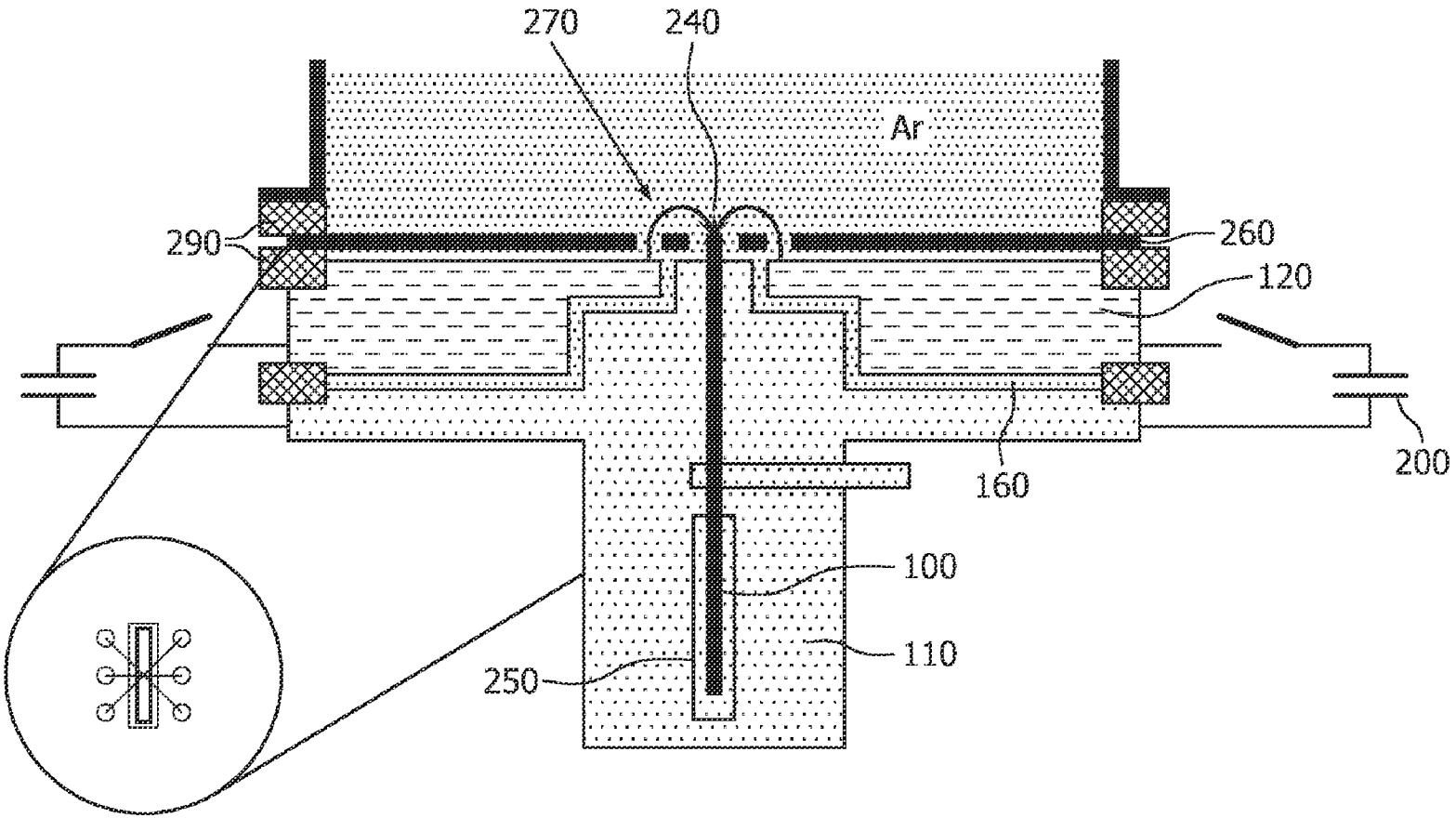
Figure 5:
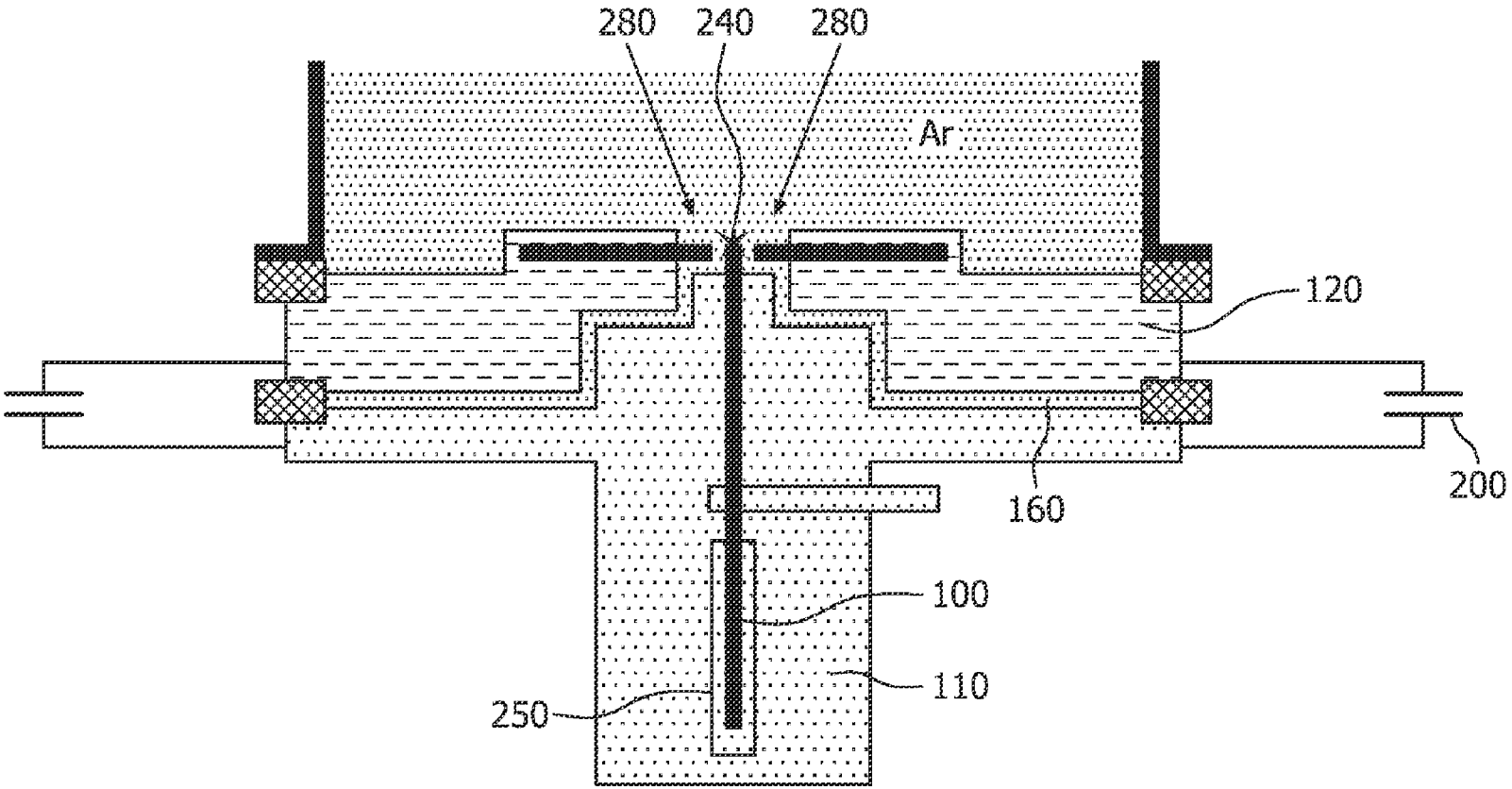

In the drawings:

FIG. 1 is a diagrammatic view of a known gas discharge source in accordance with the state of the art;

FIG. 2 diagrammatically shows a further known gas discharge source in accordance with the state of the art;

FIG. 3 diagrammatically shows, in two views, an example of an embodiment of the proposed gas discharge source;

FIG. 4 diagrammatically shows a further example of an embodiment of the proposed gas discharge source; and FIG. 5 diagrammatically shows a further example of a possible embodiment of the proposed gas discharge source.

POSSIBLE EMBODIMENTS OF THE INVENTION

The gas discharge sources in accordance with the prior art shown in FIGS. 1 and 2 have already been explained in the opening paragraph. The structure and operation of the electrode systems of said gas discharge sources cause the solid angle, in which the generated radiation is emitted, to be clearly reduced. By means of the proposed gas discharge source, this solid angle can be clearly enlarged.

For example, FIG. 3 shows a first example of a possible embodiment of the proposed gas discharge source in two sectional views taken at 90° through the electrode system. External components, such as the handling of the liquid target material, the capacitor bank or the drive of the electrode disk, hereinafter also referred to as cathode wheel, are each indicated only once in a diagrammatic way. In this very advantageous embodiment of the gas discharge source, only the cathode is configured so as to be a rotatable cathode wheel 100, which is rotatably mounted in a cathode body 110. The cathode wheel 100 which is driven by means of a rotary drive 130 is constantly moistened with a thin tin film supplied by means of a device for supplying liquid tin 140.

This device for supplying liquid tin 140 may be a tin reservoir formed in the cathode body 110, into which reservoir the cathode wheel 100 is partially immersed. In addition, the cathode body 110 may alternatively take the form of a metal block, as described in DE 10 2005 023 060 A1, which surrounds part of the circumference of the cathode wheel, thereby forming an intermediate gap, and which at least comprises a supply channel to the intermediate gap in order to supply liquid tin via the intermediate gap to the radial outer surface of the cathode wheel 100.

The cathode body 110 is laterally enclosed by an anode body 120 which, in this example, is designed so as to be dome-shaped. At the upper side, this anode body 120 forms a gap for allowing passage of the cathode wheel 100, as shown in FIG. 3. With the exception of the area of the upwardly projecting cathode wheel 100, the anode body 120 and the cathode body 110 are designed so as to be rotationally symmetrical about the axle 150, such that a narrow gap 160, in this case 2 nm wide, is formed between the anode body 120 and the cathode body 110.

The anode body 110 and the cathode body 120 can be insulated with respect to each other by means of, for example, a ceramic ring 170. This ring may simultaneously form the interface with the vacuum vessel, which encloses the electrode system, and is not shown in this Figure. In addition, it may be advantageous if the two electrode bodies are insulated with respect to the vacuum vessel itself by means of an insulator ring 180. It is thus precluded that a part of the discharge current flows from the electrodes to the walls of the vacuum vessel.

The laser pulse 190 for evaporating a small amount of tin from the radial outer surface of the cathode wheel 100 can, for example, be directly emitted from above downward, as shown in FIG. 3. The current flow from cathode to anode takes place by means of a plasma, indicated by means of dots, above the electrode body, which plasma is also formed, however, as a result of the tin vapor, by ionized gas in the electrode space. Provided that the cathode wheel 100, at its highest location, projects above the contour of the anode body 120, as is the case in this example, the generated EUV radiation in the entire upper half space is not shadowed by the electrodes.

Of course, this electrode system can also be differently spatially arranged or oriented, such that the corresponding half space is irradiated. The electrodes can in principle be arranged in any direction, so that also the radiation can be used in any spatial direction.

The energy storage supplying the electrodes with a pulse current of approximately 10 to 20 kA, may consist, for example, of a parallel arrangement of a plurality of capacitors in a capacitor bank 200. These capacitors are advantageously arranged in an annular form very close to the cathode and the anode in order to achieve a low-inductance transition.

The cathode wheel 100 is advantageously driven by means of a motor which is situated outside the vacuum vessel. In the case of an arrangement as shown in FIG. 3, the direction of rotation must thus be diverted through, for example, 90°. Due to the abrasion of lubricant-free gear wheels in a vacuum, an angular gear is unsuitable. Therefore, for the drive use is advantageously made of a toothed belt or a similar structure, which is designed to withstand temperatures above 250° C. Thus, for example, one or two disks 220 can be attached to the axle 210 of the cathode wheel 100, said disks exhibiting a row of pins extending radially outward. For the drive belt use can then be made, for example, of a thin metal belt provided with apertures, which runs on the disk 220 and drives it via the pins. Said belt is connected with the motor of the rotary drive 130, which is situated outside the vacuum vessel. The bearing of the rotational axle 210 may be embodied, for example in the area of the electrode body, as a vacuum seal. In this case, the disk 220 with the drive belt is also situated outside the vacuum.

In order to achieve that, after exposure of the cathode wheel 100 to the radiation of the laser pulse 190 and the associated ablation of tin, the current flow to the anode is brought about, an electrically conductive plasma must develop between the electrodes or be present already between the electrodes. Provided that the vacuum vessel contains a gas at a low pressure of, for example, a few Pa, this gas is automatically ionized by the operation of the gas discharge source. Due to the small distance between anode body 110 and cathode body 120 of, for example, 2 mm, this ionized gas will recombine between two discharge pulses at the walls of anode body 120 and cathode body 110 which are situated opposite each other in this gap. In the area above the electrodes, the distance to the walls of the electrode bodies increases, so that at least at high pulse repetition rates of >1 kHz, no complete recombination can take place. By virtue thereof, right from the beginning of every subsequent discharge pulse or laser pulse, a conductive plasma for current transport is available. Other suitable parameters that can be set are, for example, the gas pressure, the gas type or the repetition frequency for optimum operation of the gas discharge source. In addition, it is also possible to continuously maintain a plasma in the discharge area 240 by means of a device for pre-ionization, for example using a DC discharge or a high frequency discharge. The high frequency discharge can also take place in a pulsed manner and be temporally suitably synchronized with the charging of the capacitors and with the laser pulse. This discharge may additionally be characterized in that, as a result of sputtering, the tin deposited on the stationary anode is removed again such that only a "protective film" of constant thickness of, for example, a few tens of micrometers is formed.

FIG. 4 shows a further possible embodiment of the proposed gas discharge source. Also in this Figure, the cathode body 110 comprising the cathode wheel 100 mounted therein is shown, said cathode body comprising, in this case, a tin reservoir 250 into which a section of the cathode wheel 100 is immersed. In an area below the discharge area 240, the cathode body 110 is laterally enclosed by an anode body 120. In a direction perpendicular to its radial outer surface, the cathode wheel 100 projects above the anode body 120 in the area 240 where the discharge takes place, as is shown in the Figure. Also in this example, the anode body and the cathode body are designed so as to be rotationally symmetrical, with the exception of the area of the cathode wheel 100. The Figure also shows the annularly arranged capacitor bank 200. In this example, an intermediate plate 260 is arranged above the anode body 120. This intermediate plate 260 is provided with a central gap for allowing passage of the cathode wheel 100, and at least one bore hole. These bore holes serve for prescribing tracks for current paths between cathode and anode. In the lower left part of the drawing, a plan view of this intermediate plate 260 is shown, in which the individual bore holes, the gap through which the cathode wheel 100 passes, and the current paths 270 are shown. The intermediate plate 260 may be made of a metal, in which case, however, it should be insulated with respect to the other components. In the Figure, this is achieved by means of an insulator ring 290.

FIG. 5 shows a further possible embodiment of the proposed gas discharge source. The structure is similar to that shown in FIG. 4, in particular as regards the shape of the cathode. In this example, however, the anode body 120 comprises, in the upper region near the discharge area 240, two anode wheels 280 which extend as far as the discharge area 240. By means of these rotating anode wheels 280, the tin removed from the cathode by the laser and the discharge and deposited on other surfaces can be carried away, and efficient cooling of the anode can be achieved. The drive mechanism and the means for removing the tin from the anode wheels 280 are not shown in this Figure.

CAPTIONS TO THE DRAWINGS

1 electrode disks
2 vacuum chamber
3 rotation axle
4 reservoir
5 liquid metal
6 gas discharge
7 laser pulse
8 device for reducing debris
9 metallic screen
10 screen
11 scraper
12 capacitor bank
13 electric leadthroughs
14 metal block
15 reservoir
16 supply channel
17 return channel
18 source point
19 gap
20 inlet
21 outlet
100 cathode wheel
110 cathode body
120 anode body
130 rotary drive
140 device for supplying liquid tin
150 axle
160 gap
170 ceramic ring
180 insulator ring'
190 laser pulse
200 capacitor bank
210 axle
220 disk
240 discharge area
250 tin reservoir
260 intermediate plate
270 current paths
280 anode wheels
290 insulator ring.

The invention claimed is:

1. Gas discharge source for generating EUV radiation and/or soft X-radiation, the source comprising two electrode bodies, of which a first electrode body comprises a rotatably mounted electrode disk, a rotary drive for the electrode disk, a device for applying a liquid film of a target material (140) onto a radial outer surface of the electrode disk, and a laser for emitting a laser beam which is focused, in a discharge area, onto the radial outer surface of the electrode disk, in order to evaporate target material from the liquid film, wherein between the electrode bodies an intermediate space is formed, the width of the intermediate space outside the discharge area is less than 5 mm relative to a distance in the discharge area.

2. Gas discharge source as claimed in claim 1, wherein the second electrode body does not project above the electrode disk in a direction perpendicular to the disk's radial outer surface in the discharge area.

3. Gas discharge source as claimed in claim 2, wherein the electrode disk projects above the second electrode body in a direction perpendicular to its radial outer surface in the discharge area.

4. Gas discharge source as claimed in claim 1, wherein the second electrode body laterally encloses the first electrode body.

5. Gas discharge source as claimed in claim 4, wherein the second electrode body comprises a gap in a part facing the discharge area for allowing passage of the electrode disk, and is otherwise designed so as to be rotationally symmetrical about the first electrode body.

6. Gas discharge source as claimed in claim 4, wherein the second electrode body is dome-shaped.

7. Gas discharge source as claimed in claim 1, wherein the rotary drive comprises a belt via which a motor (230) drives the electrode disk.

8. Gas discharge source as claimed in claim 1, wherein the electrode bodies are arranged in a vacuum vessel, in which a gas pressure of $\geqq 1$ Pa has been set.

9. Gas discharge source as claimed in claim 1, wherein the intermediate space is designed so as to be a gap between the electrode bodies.

10. Gas discharge source as claimed in claim 1, wherein the intermediate space is at least partly filled with an insulating material.

11. Gas discharge source as claimed in claim 1, wherein at the location of the discharge area, an intermediate plate is arranged having a slot for allowing passage of the electrode disk and one or more apertures for prescribing current paths between the electrode bodies.

12. Gas discharge source as claimed in claim 1, wherein the second electrode body is stationary.

13. Gas discharge source as claimed in claim 1, wherein the second electrode body comprises one or more rotatable components (280), which extend as far as the discharge area.

14. Gas discharge source as claimed in claim 1, wherein the discharge source comprises a device for pre-ionizing a gas present in the discharge area.

* * * * *